US009388652B2

(12) United States Patent
Johnson

(10) Patent No.: US 9,388,652 B2
(45) Date of Patent: Jul. 12, 2016

(54) HYDRAULIC JAR WITH MULTIPLE HIGH PRESSURE CHAMBERS

(71) Applicant: Orren Johnson, Edmonton (CA)

(72) Inventor: Orren Johnson, Edmonton (CA)

(73) Assignee: Wenzel Downhole Tools Ltd., Edmonton (CA)

( * ) Notice: Subject to any disclaimer, the term of this patent is extended or adjusted under 35 U.S.C. 154(b) by 677 days.

(21) Appl. No.: 13/850,086

(22) Filed: Mar. 25, 2013

(65) Prior Publication Data

US 2013/0248253 A1 Sep. 26, 2013

(30) Foreign Application Priority Data

Mar. 23, 2012 (CA) ..... 2772515

(51) Int. Cl.
*E21B 31/113* (2006.01)

(52) U.S. Cl.
CPC ..... *E21B 31/1135* (2013.01)

(58) Field of Classification Search
CPC ..... E21B 31/1135; E21B 31/113; E21B 4/14
See application file for complete search history.

(56) References Cited

U.S. PATENT DOCUMENTS 4,361,195 A * 11/1982 Evans ..... E21B 31/113 166/178
4,582,148 A * 4/1986 Walter ..... E21B 31/1135 175/297
5,033,557 A * 7/1991 Askew ..... G05D 7/0186 166/178
5,174,393 A * 12/1992 Roberts ..... E21B 31/113 166/178
5,431,221 A * 7/1995 Roberts ..... E21B 31/113 166/178
5,447,196 A * 9/1995 Roberts ..... E21B 31/113 166/178
5,595,244 A * 1/1997 Roberts ..... E21B 31/113 166/178
5,775,423 A * 7/1998 Kaczynski ..... E21B 31/1135 166/178
5,906,239 A * 5/1999 Oettli ..... E21B 31/1135 166/178
6,675,909 B1 * 1/2004 Cowart ..... E21B 31/1135 173/78
8,230,912 B1 * 7/2012 Connell ..... E21B 4/14 166/178
2003/0070842 A1 * 4/2003 Bailey ..... E21B 7/06 175/24
2009/0277690 A1 * 11/2009 Swinford ..... E21B 31/1135 175/296
2012/0018144 A1 * 1/2012 Shoyhetman ..... E21B 31/113 166/178
2013/0248253 A1 * 9/2013 Johnson ..... E21B 31/1135 175/297
2014/0048247 A1 * 2/2014 Watson ..... E21B 19/22 166/72

* cited by examiner

*Primary Examiner* — Jennifer H Gay
(74) *Attorney, Agent, or Firm* — Christensen O'Connor Johnson Kindness PLLC

(57) ABSTRACT

A hydraulic jar having multiple high pressure chambers includes a jar body comprising an inner body telescopically engaged by an outer body. There is a first contact surface carried by the inner body, and a second contact surface carried by the outer body that engage when the jar body is moved to the jarring position. A plurality of axially spaced pressure chambers are spaced axially along the jar body, with each pressure chamber having a hydraulic delay section and a jarring section. A piston separates the pressure chamber. A hydraulic delay is in fluid communication with a high pressure section and a low pressure section of each pressure chamber and permits movement of the piston toward the second end at a first speed. A jarring valve permits movement of the piston toward the second end at a second speed that is greater than the first speed when in a japing section.

7 Claims, 10 Drawing Sheets

HYDRAULIC JAR WITH MULTIPLE HIGH PRESSURE CHAMBERS

FIELD

This relates to a hydraulic jar, such as a hydraulic drilling jar used in a downhole drill string.

BACKGROUND

Hydraulic jars, most commonly used as drilling jars, are a common category of drilling jar that has been in use for many decades. A prominent feature of this category of drilling jar is that when a tensile load is applied the jar will telescope open slowly for the initial phase often referred to as hydraulic delay. The hydraulic delay is created by a fluid, typically hydraulic oil, passing through a region of high resistance such as a small orifice from a high pressure chamber to a low pressure chamber. An example of a prior art drilling jar is shown in FIG. 1.

As the tensile force increases, the pressure in the high pressure chamber also increases. A limitation of this category of jar occurs when the pressure in this chamber becomes excessive. Excessive pressure may cause the outer housing to rupture, the inner mandrel to collapse, the seals to fail, or a combination of these. This limitation is more prominent with drilling jars that have reduced wall thickness. Larger inner diameter drilling jars typically result in increased pressure for the same tensile force.

A second category of drilling jar has the hydraulic delay feature mentioned above in addition to a pressure relief valve. This feature prevents the jar from telescoping open until the applied tensile force is high enough to cause the pressure relieve valve to open. A limitation of this design is the maximum pressure these pressure relief valves release at.

SUMMARY

There is provided a hydraulic jar having multiple high pressure chambers, comprising a jar body comprising an inner body telescopically engaged by an outer body, the jar moving telescopically between a pre jarring position and a jarring position. There is a first contact surface carried by the inner body, and a second contact surface carried by the outer body, the first contact surface axially engaging the second contact surface when the jar body is moved to the jarring position. There are a plurality of axially spaced pressure chambers, each pressure being defined radially by the outer body and the inner body, and defined axially by a first seal element at a first end of the pressure chamber and a second seal element at a second end of the pressure chamber. Each pressure chamber comprises a hydraulic delay section toward the first end of the pressure chamber and a jarring section toward the second end of the pressure chamber. A piston separates the pressure chamber into a high pressure section and a low pressure section and moves relative to the pressure chamber. A hydraulic delay is in fluid communication with the high pressure section and the low pressure section and that permits movement of the piston toward the second end at a first speed. There is a jarring valve that is closed when the piston is in the hydraulic delay section, and is open when the piston is in the jarring section, the open jarring valve permitting movement of the piston toward the second end at a second speed that is greater than the first speed.

According to another aspect, the first and second seal elements of the pressure chambers may be carried by the inner body, and the piston is carried by the outer body.

According to another aspect, the second seal element of a first pressure chamber may comprise the first seal element of a second pressure chamber adjacent to the first pressure chamber.

According to another aspect, the jarring valve may comprise an enlarged flow area between the inner body and the outer body such that hydraulic fluid escapes around the piston from the high pressure section to the low pressure section.

According to another aspect, the hydraulic delay may comprise one or more flow orifices that restrict the flow of hydraulic fluid to a predetermined rate.

According to another aspect, each pressure chamber may further comprise a pressure relief valve that opens upon application of a predetermined hydraulic pressure to the piston in the hydraulic delay section.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
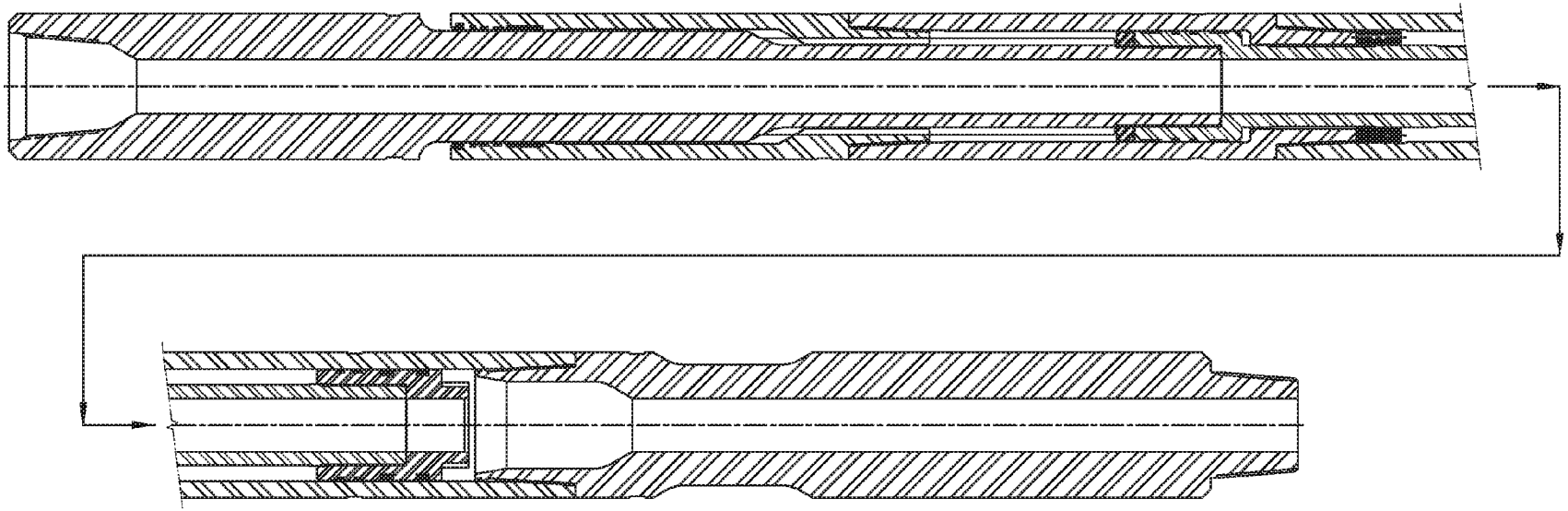
FIG. 1 (PRIOR ART)
FIG. 1 is a side elevation view in section of a prior art hydraulic jar.
Figure 2:
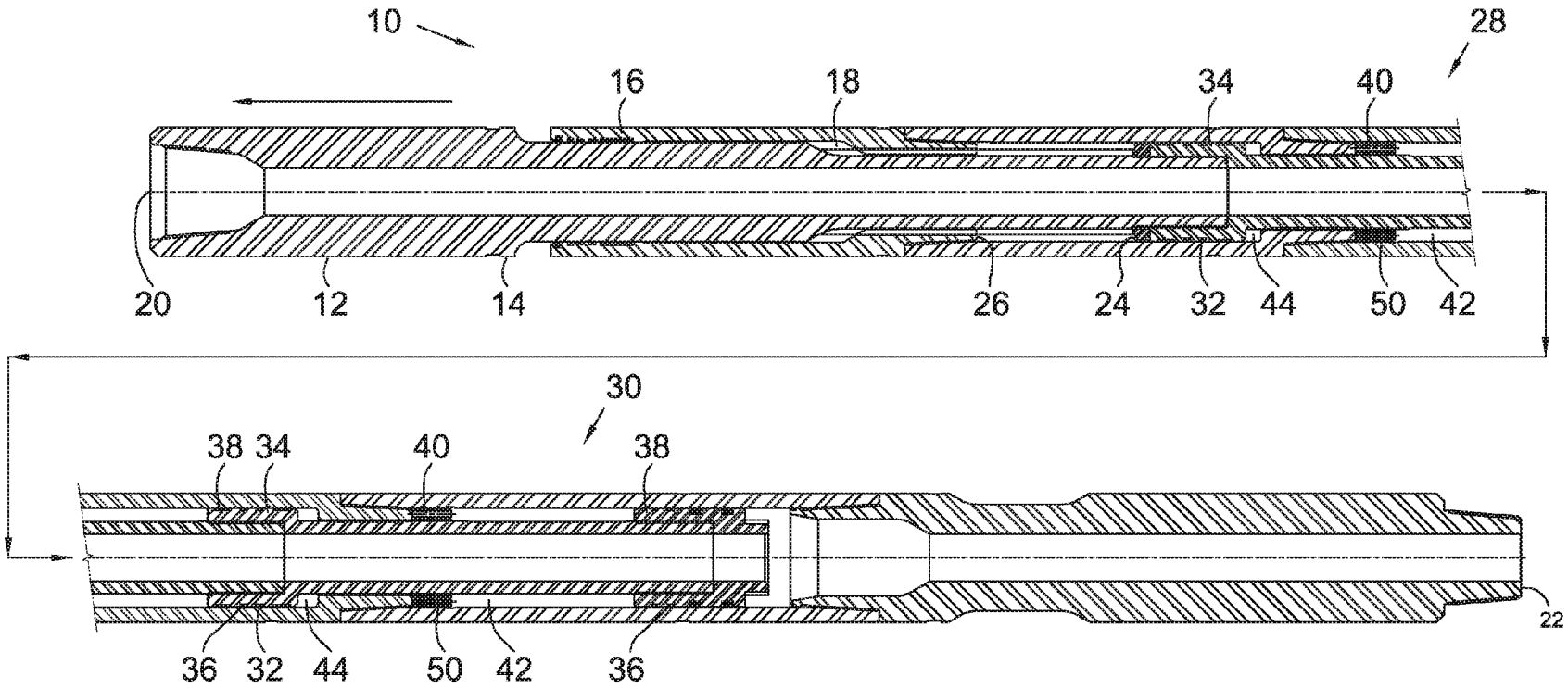
FIG. 2 is a side elevation view in section of a hydraulic jar in a substantially retracted position.

Referring to FIG. 2, a hydraulic jar 10 is depicted that has a jar body 12 made up of an inner body 14 telescopically engaged by an outer body 16. Jar body 12 moves between a retracted position shown in FIG. 2 and an extended position shown in FIG. 3. Inner body 14 and outer body 16 are preferably connected in a non-rotatable manner, such as by using a splined engagement 18. Jar body 12 is intended to be connected in a downhole string (not shown) by a first connection 20 at one end and a second connection 22 at the other. The telescopic movement permits the jarring forces to be applied to the downhole string, generally a drill string.

Referring to FIG. 2, jarring forces are applied by accelerating inner body 14 relative to outer body 16 and causing a first contact surface 24 carried by inner body 14 to axially engage a second contact surface 26 carried by outer body 16. It will be understood that, depending on the arrangement of jar body 12, it may be either inner body 14 or outer body 16 that moves. In other words, when movement is described herein, it is movement that is relative to the other components in the hydraulic jar, rather than from a remote reference point, such as the tubing string or a person on surface. For example, in the depicted embodiment, force is applied to inner body 14 to pull it out from outer body 16, such that, from the perspective of a remote observer, inner body 14 would move and outer body 16 would remain stationary. However, jar body 12 could also be designed such that outer body 16 moves upon application of a force and inner body 14 remains stationary relative to a remote observer. In either situation, the movement may be describes as inner body 14 moving relative to outer body 16, or outer body 16 moving relative to inner body 14.

Figure 3:
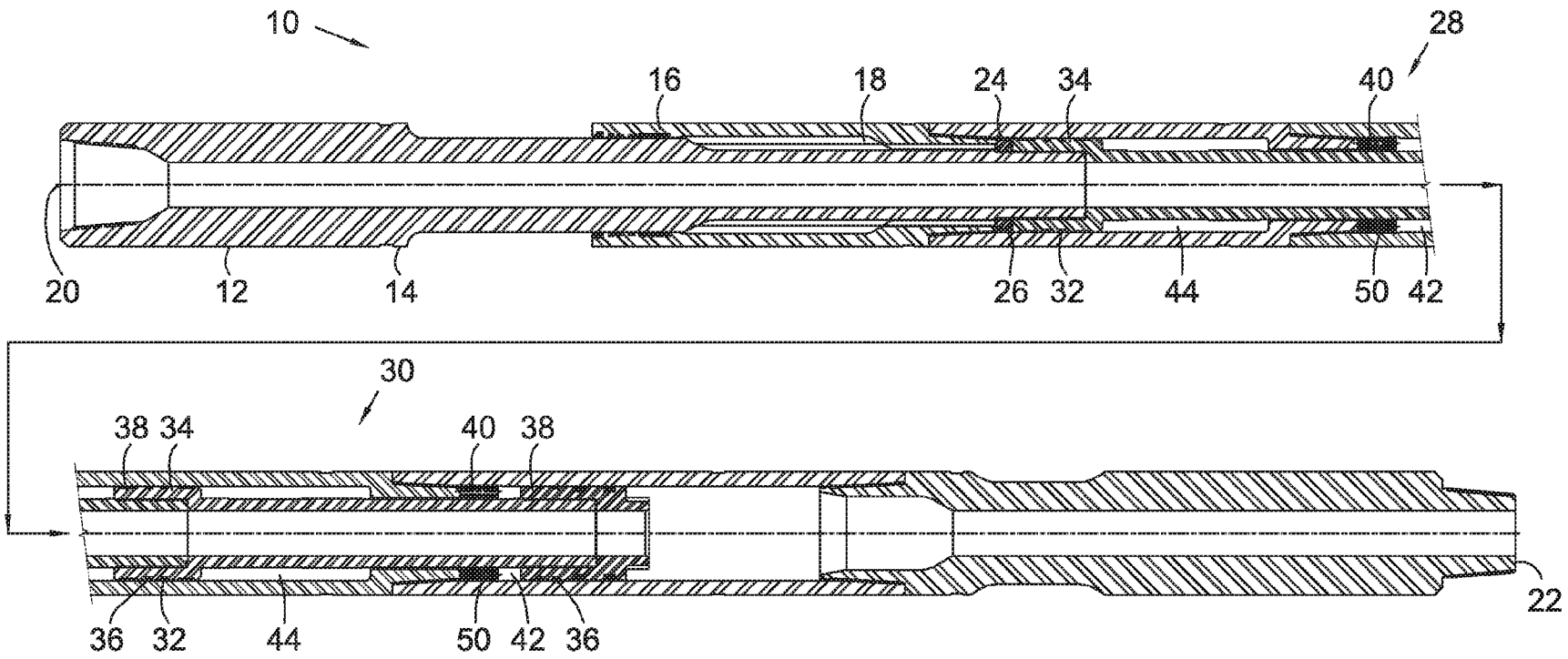
FIG. 3 is a side elevation view in section of a hydraulic jar in an extended position.

The most common use of the present design is when jarring in the upward direction by applying tension to jar body 12. However, the use of multiple high pressure chambers described herein could be a design feature in a drilling jar for jarring upward as shown in FIGS. 2 and 3, downwards (by applying a compressive force), or in a double-acting jar, which will be described later with respect to FIGS. 7-12.

Referring to FIGS. 2-5, a hydraulic jar designed to apply a jarring force in one direction is depicted. Referring now to FIG. 2, jar body 12 is designed with a plurality of axially spaced pressure chambers. In the embodiment shown in FIG. 2, two pressure chambers 28 and 30 are depicted, although it will be understood that the teachings may be expanded to include more pressure chambers if desired or necessary. However, the largest incremental benefit is seen from including a second chamber. As shown, each pressure chamber 28 and 30 is defined radially by outer body 16 and inner body 14, and defined axially by a first seal element 32 at a first end 34 of each pressure chamber 28/30 and a second seal element 36 at a second end 38 of each pressure chamber 28/30.

Figure 4:
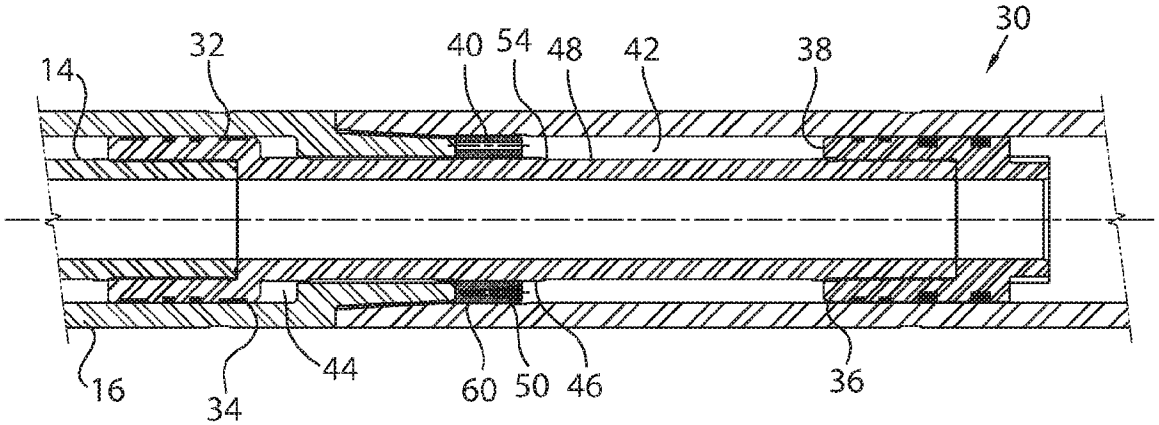
FIG. 4 is a detailed side elevation view in section of a hydraulic chamber in a substantially retracted position.

Referring now to FIG. 4, a more detailed description of second pressure chamber 30 will be given. It will be understood that first pressure chamber 28 has similar components. It will also be understood that, while there are only minor differences between pressure chambers 28 and 30 to reflect their relative position in hydraulic jar 12, this need not be the case, provided that they are properly designed to work together as will be described below. It will also be understood that the description below is of a preferred embodiment, and that modifications to this design may be made based on the design principles that are explicitly and implicitly discussed.

Referring to FIG. 4, as depicted, pressure chamber 30 is defined between first seal element 32 and second seal element 36, and there is a piston 40 that separates pressure chamber 30 into a high pressure section 42 and a low pressure section 44. When an upward force is applied to inner body 14, pressure chamber 30 moves relative to piston 40. As can be seen, seal elements 32 and 36 are carried by inner body 14 while piston 40 is carried by outer body 16. As depicted, seal elements 32/36 are integrally formed as part of inner body 14, which is divided into sections and is assembled by threading the separate sections together. Second seal element 36 of second pressure chamber 30 is a seal that is threaded onto the end of the last section without a tubular component, or with a truncated tubular component. Referring to FIG. 2, first seal element 32 of first pressure chamber 28 carries first contact surface 24 opposite first pressure chamber 30. Referring still to FIG. 2, it can be seen that second seal element 36 of first pressure chamber 28 also serves as first seal element 32 for second pressure chamber 30. Each seal element 32/36 seals against the inner surface of outer body 16. Referring to FIG. 4, piston 40 is integrally formed as part of outer body 16, which is also divided into sections and is assembled by threading the separate sections together. Piston 40 moves within and relative to pressure chamber 30. Piston 40 is intended to seal against inner body 14, subject to the hydraulic delay, jarring valve and optional pressure release valve discussed below.

Within pressure chamber 30, there is a hydraulic delay section 46 toward first end 34 of pressure chamber 30 and a jarring section 48 toward second end 38 of pressure chamber 30. Hydraulic delay section 46 permits movement of piston 40 relative to pressure chamber 30 at a controlled rate, or a rate that is slower than what is permitted in jarring section 48. This is done by providing a hydraulic delay 50 that is in fluid communication with high pressure section 42 and low pressure section 44 that permits movement of piston 40 as fluid is allowed to pass through hydraulic delay 50. The example of hydraulic delay 50 shown in FIG. 6 has an orifice 52 that controls the flow rate of hydraulic fluid from high pressure section 42 to low pressure section 44. There may be more than one orifice 52 in hydraulic delay section 46. There may be one or more hydraulic delays 50 spaced about piston 40, provided that the total flow area provides the desired delay. Referring to FIG. 4, the combined flow area through the one or more orifices allows the movement of inner body 14 relative to outer body 16 to be controlled to allow the operators sufficient time to prepare for the jar, and to build up a sufficient jarring force. As shown, hydraulic delay 50 is part of the piston 40. FIG. 4 shows piston 40 partway through hydraulic delay section 46.

Figure 5:
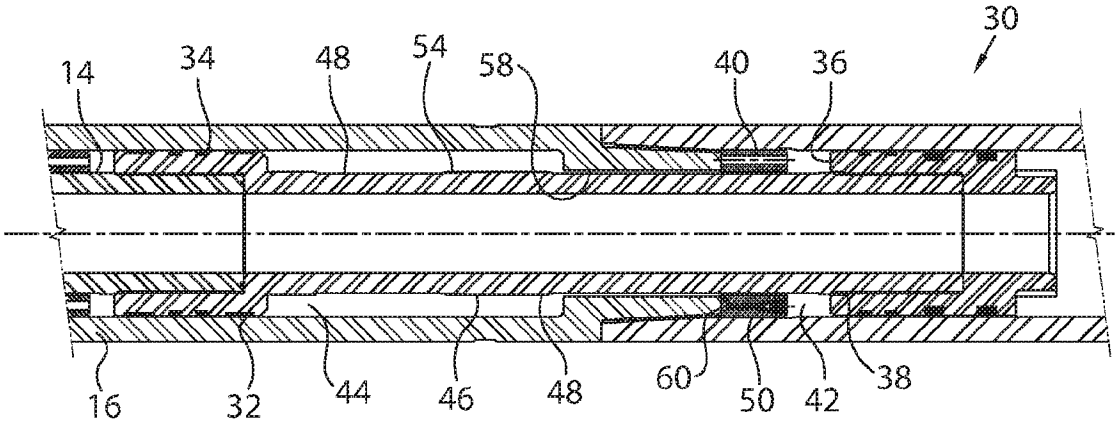
FIG. 5 is a detailed side elevation view in section of a hydraulic chamber in an extended position.

Referring to FIG. 5, once piston 40 has traversed hydraulic delay section 46, it encounters jarring section 48, which permits a greater flow of hydraulic fluid from high pressure section 42 to low pressure section 44. This permits piston 40 to move relative to hydraulic chamber 30. Piston 40 continues to move until first and second contact surfaces 24 and 26 come into contact and apply the jarring force to jar body 12 as shown in FIG. 3. This occurs as a jarring valve 54 that is closed when piston 40 is in hydraulic delay section 46 is opened when piston 40 is in jarring section 48, which as depicted is a reduced diameter section that allows fluid to flow at a higher rate. It will be understood that, from the perspective of the tubing string and based on the design of the depicted example, a lifting force is applied to inner body 14 such that piston 40 actually remains stationary while hydraulic chamber 30 moves upward, such that an upward jarring force is applied by first contact surface 24 to second contact surface 26.

As depicted in FIG. 5, jarring valve 54, which may also be referred to as a valve mandrel, is made up of a reduced diameter section 48 of inner body 14 and the inner sealing surface 58 of piston 40. As piston 40 encounters reduced diameter section 48, hydraulic fluid is permitted to flow around piston 40 from high pressure section 42 to low pressure section 44. The flow area is designed to permit a high volume of fluid flow to permit a high relative velocity within jar body 12.

Figure 6:
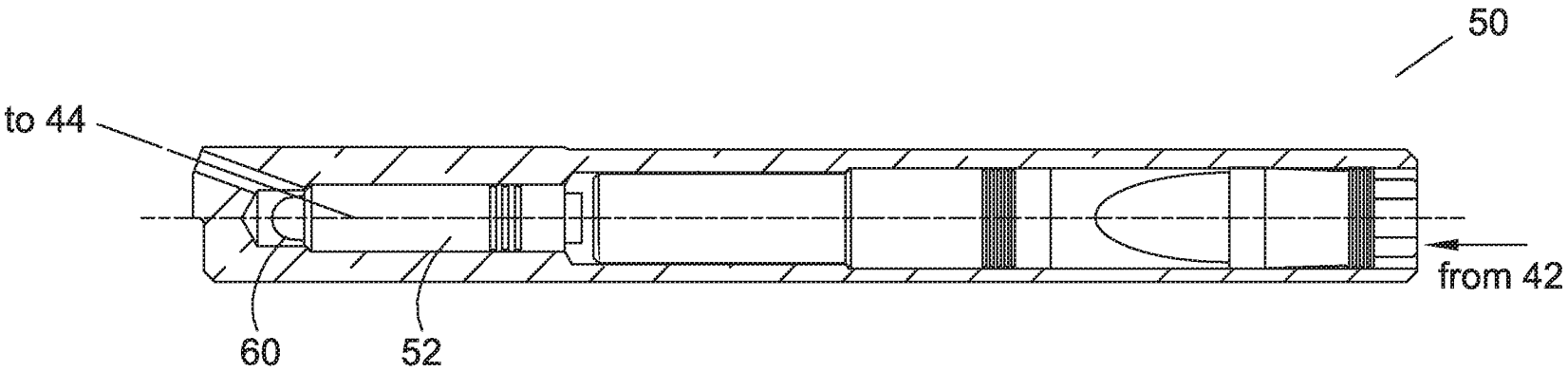
FIG. 6 is a detailed side elevation view in section of a hydraulic delay element.

In addition to hydraulic delay 50 and jarring valve 54, there may also be a pressure relief valve 60 that acts to relieve the pressure in high pressure section 42 when a pressure threshold is reached. Pressure relief valve 60 is shown in FIG. 6 as being a part of hydraulic delay 50. As significant pressure is applied, pressure relieve valve 60 is released to allow a greater flow of fluid through hydraulic delay 50. This is a preventative measure intended to reduce the risk of damage to jarring body 12.

Modifications of the above description will be apparent to those skilled in the art. For example, while the depicted example is a preferred design, it will be understood that piston 40 may be carried by inner body 14 while seal elements 32 and 36 are carried by outer body 16 to achieve the same jarring result, with necessary modifications being made, such as reduced diameter section 48 on inner body 14 becoming an increased diameter section (not shown) on outer body 16 to create the enlarged flow area required by the depicted jarring valve 54.

Referring to FIGS. 2-5, the depicted hydraulic jar 10 is designed to be run downhole in its retracted position, with first connection 20 closer to surface. Once it becomes necessary or desirable to activate jar 10, an upward force is applied to inner body 14 and hence seal elements 32 and 36. Outer body 16 has an opposing force applied to it, likely due to a component of the tubing string that is stuck downhole (not shown). This creates pressure in high pressure section 42 of each pressure chamber 28 and 30, which in turn forces fluid through hydraulic delay 50, causing each piston 40 to move toward second end 38 of each pressure chamber 28 and 30. During this time, the operators are able to modify the jarring force by either increasing or decreasing the force applied to the drill sting at surface. Once piston 40 traverses hydraulic delay section 46 and reaches jarring valve section 48, the speed of piston 40 is increased substantially by the increased flow area around piston 40. Movement continues until contact surfaces 24 and 26 are engaged to transfer the force being applied to inner body 14 to outer body 16.

Figure 7:
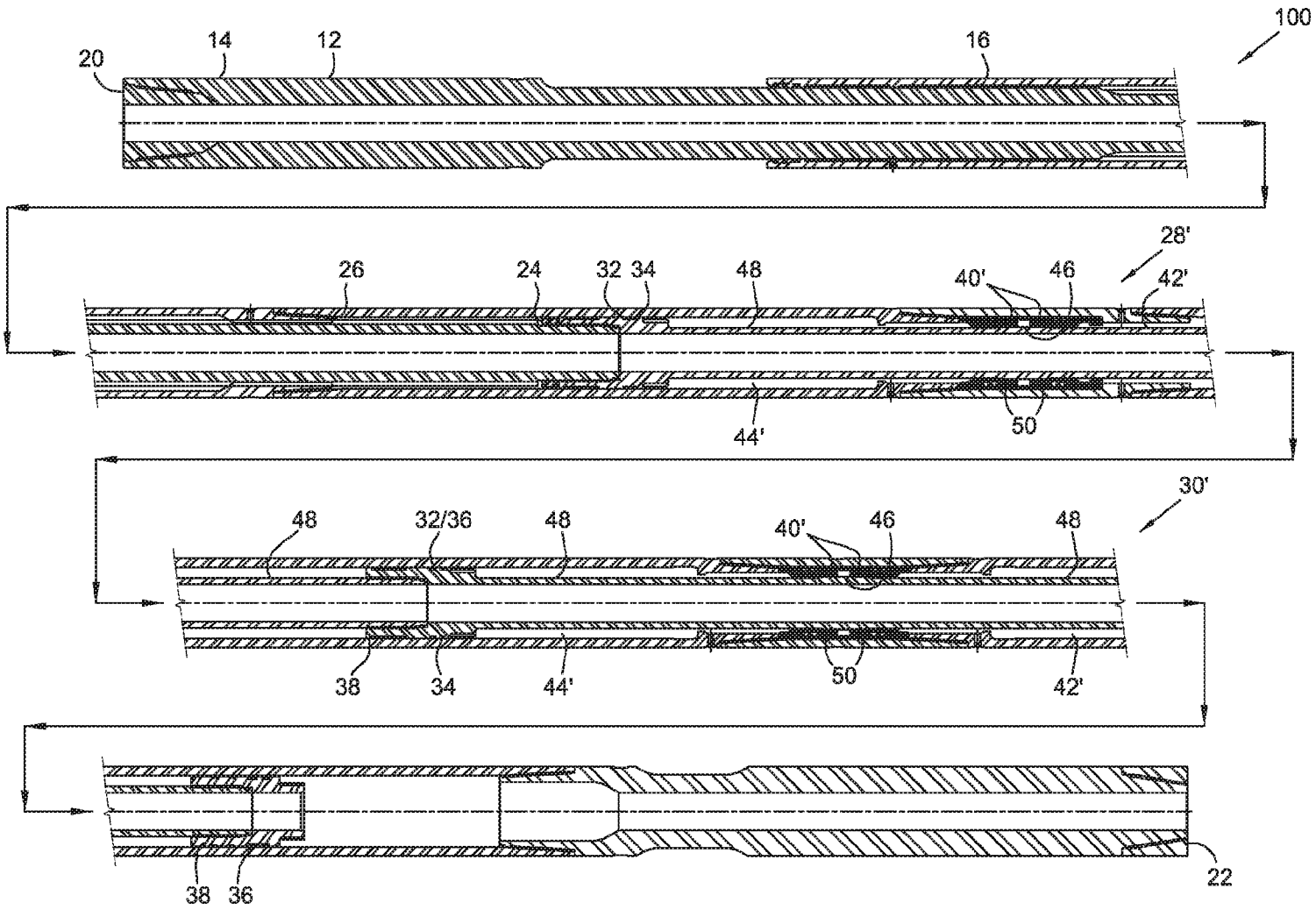
FIG. 7 is a side elevation view in section of a double-acting jar in a neutral position.
Figure 8:
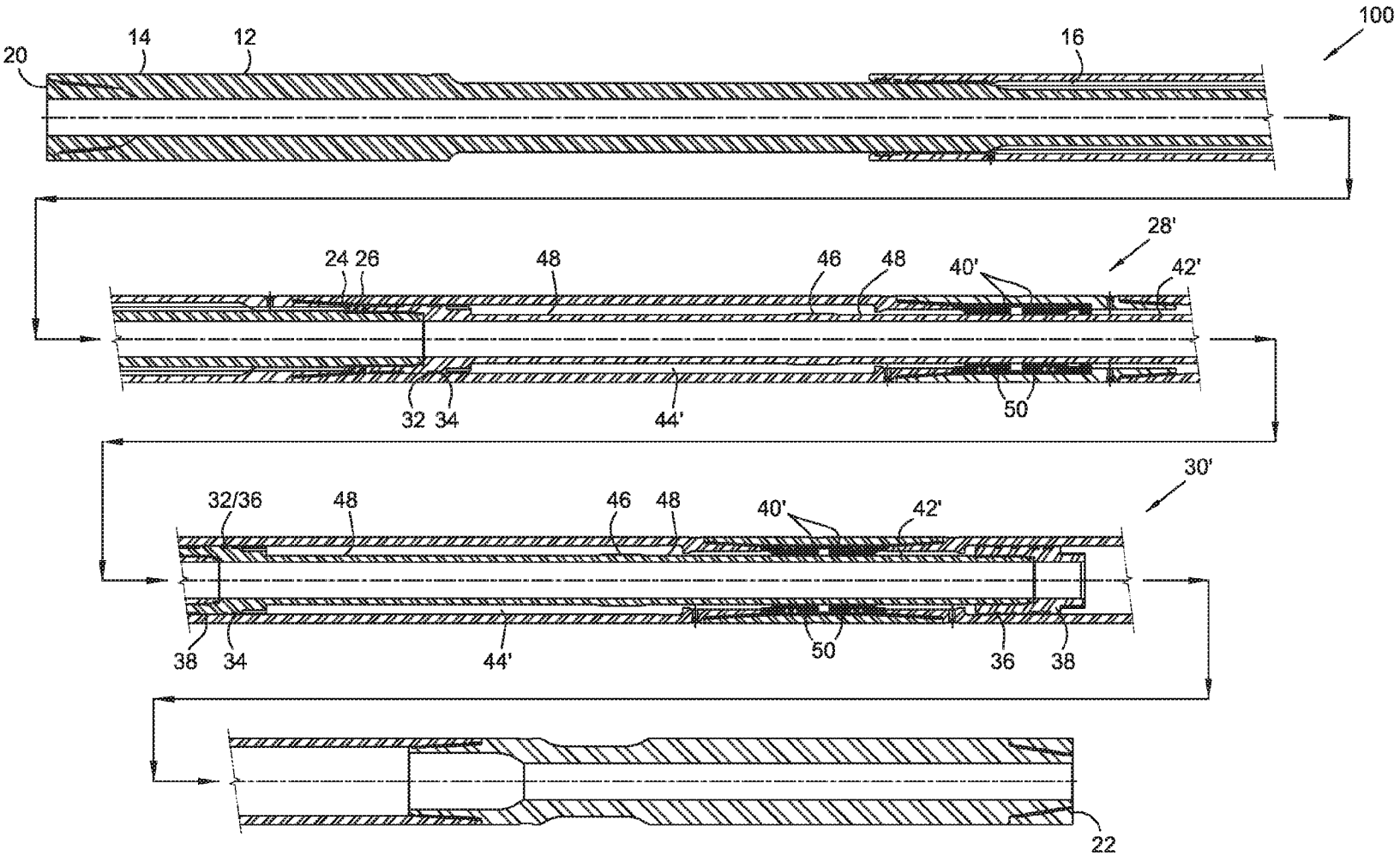
FIG. 8 is a side elevation view in section of a double-acting jar in a fully extended position.
Figure 9:
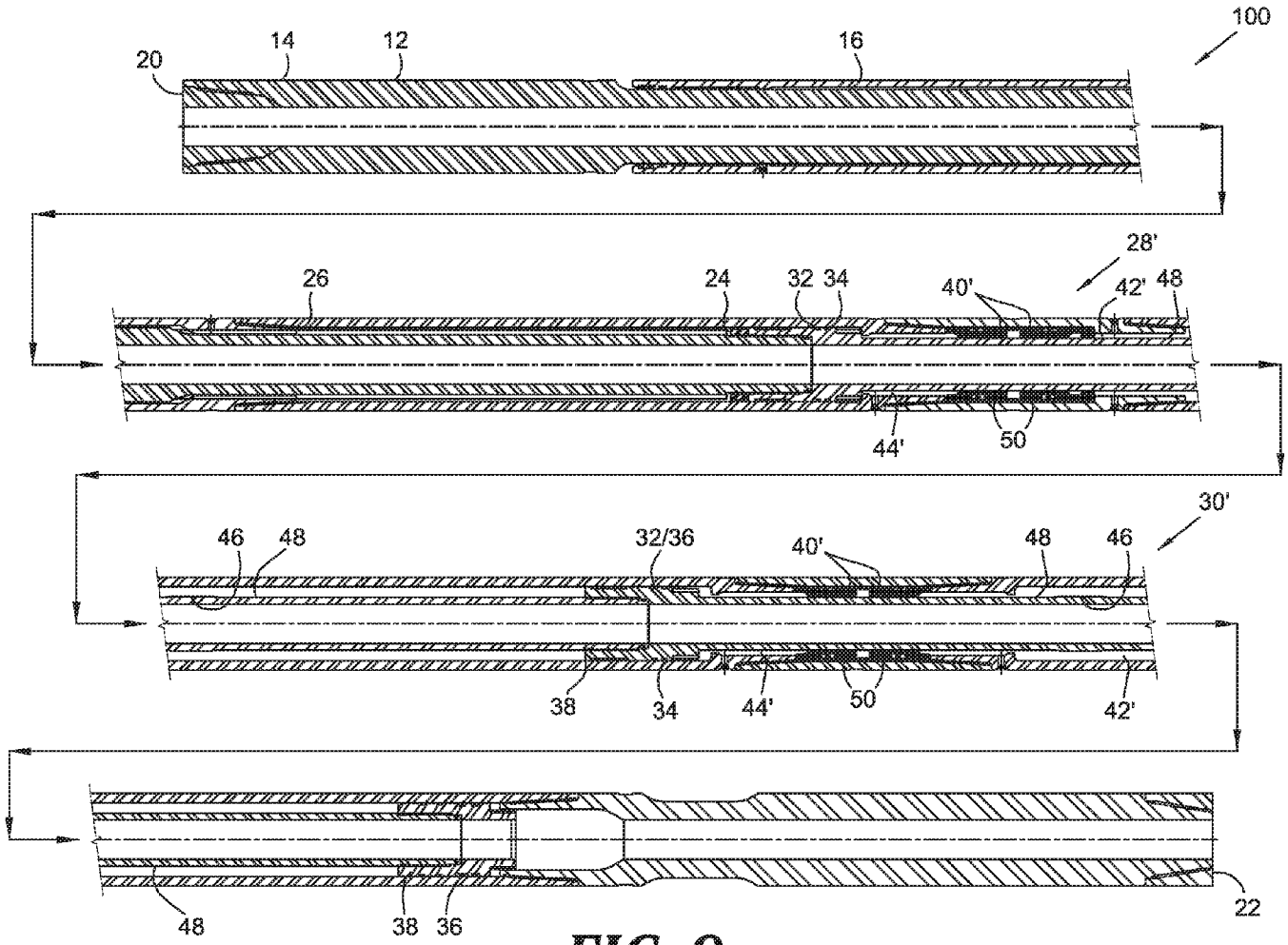
FIG. 9 is a side elevation view in section of a double-acting jar in a closed fully retracted position.
Figure 10:
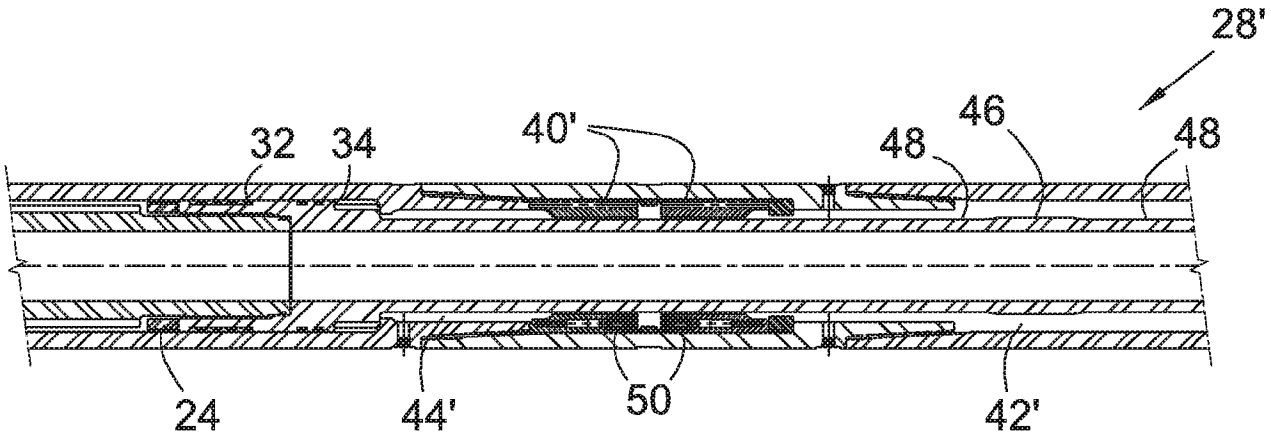
FIG. 10 is a detailed side elevation view in section of a hydraulic delay element with the double-acting jar in the fully retracted position.
Figure 11:
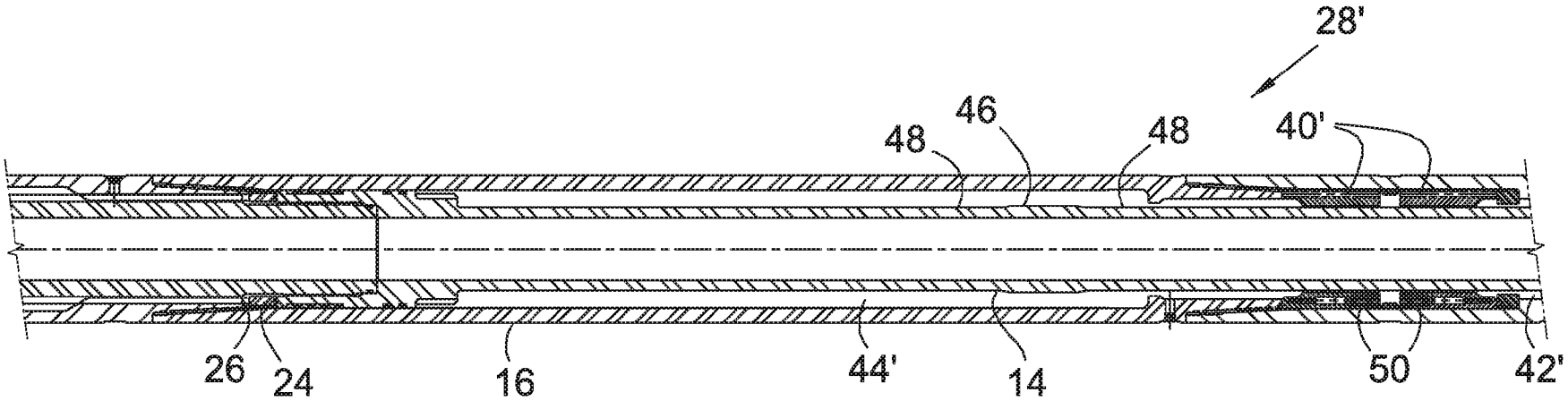
FIG. 11 is a detailed side elevation view in section of a hydraulic delay element with the double-acting jar in the fully extended position.
Figure 12:
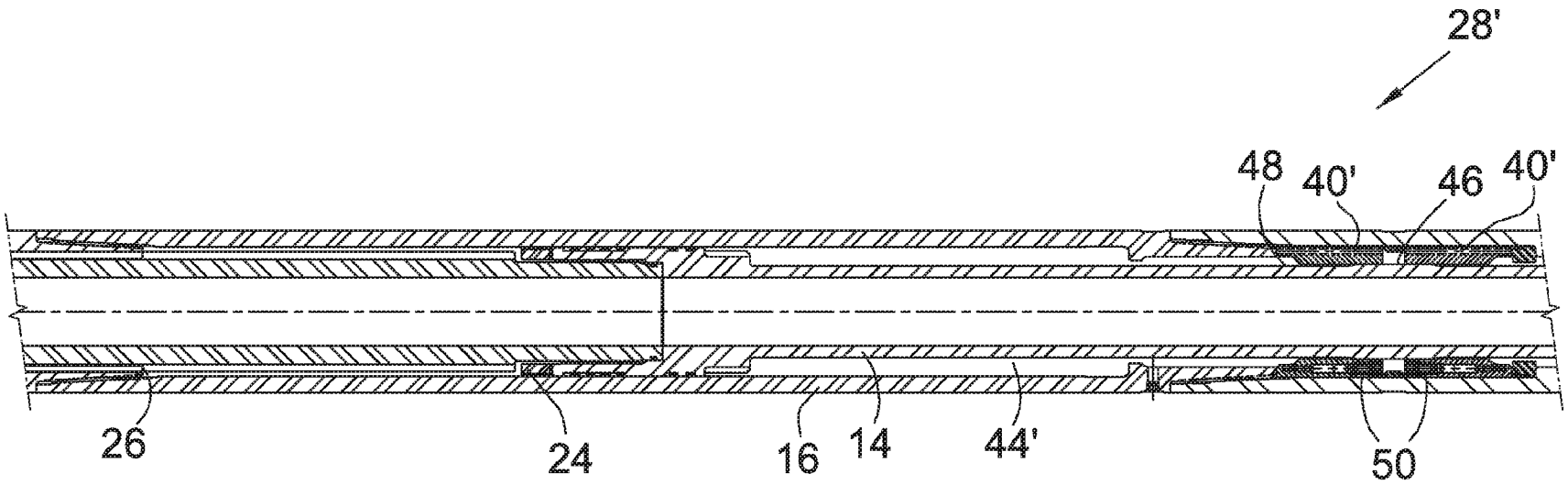
FIG. 12 is a detailed side elevation view in section of a hydraulic delay element with the double-acting jar in the neutral position.

Referring now to FIGS. 7-12, a dual-acting hydraulic jar 100 is depicted. Hydraulic jar 100 may include similar components to single-acting hydraulic jar 10, and similar reference numerals will be used to identify similar components. Referring to FIG. 7, hydraulic jar 100 is in a neutral position, where it may apply an upward jarring force, or a downward jarring force. Assuming the force is applied to the inner string, the upward jarring force is applied when hydraulic jar 100 is moved to the open position shown in FIG. 8 while the downward jarring force is applied when hydraulic jar 100 is moved to the closed position shown in FIG. 9. Each pressure chamber 28' and 30' has a piston 40' with hydraulic delays 50 oppositely oriented, as well as a hydraulic delay section 46 and jarring section 48 in each direction. It can be seen that, in this embodiment, hydraulic delays 50 are part of pistons 40', rather than separate components at an end of chamber 28 or 30, as shown in FIGS. 2-5. It will be understood that either design may be used. Pistons 40' divide pressure chambers 28' and 30' into first and second sections 42' and 44', which may be low or high pressure sections, depending on the direction of the jar. The operation of hydraulic jar 100 in each direction is similar to what is described above, and will be understood by those skilled familiar with the general operation of other dual-acting hydraulic jars known in the art.

Hydraulic jars 10 and 100 described above use multiple high pressure chambers, which significantly reduces the maximum chamber pressure compared to a single higher pressure design for the same tensile load. For example, in a two high pressure chamber design the pressure in either chamber would be approximately half of the pressure of the single high pressure design. Examples 1 and 2 described below illustrate some benefits of this approach:

Example 1

Conventional Hydraulic Drilling Jar with a large ID (inner diameter):

- Swept area of Hydraulic Valve (A1)=39 cm^2 or 6 in^2
- Maximum allowable pressure for high pressure chamber (P1)=83 MPa or 12,000 psi
- Maximum tensile load during hydraulic delay (F1)=320 kN or 72,000 lbs Hydraulic Jar with a large ID and two high pressure chambers:

- Swept area of one Hydraulic Valve (A2)=39 cm^2 or 6 in^2
- Maximum allowable pressure for high pressure chamber (P2)=83 MPa or 12,000 psi
- Maximum tensile load during hydraulic delay (F2)=640 kN or 144,000 lbs Example 2

Conventional Locking Hydraulic Drilling Jar with a large ID

- Swept area of Hydraulic Valve (A3)=39 cm^2 or 6 in^2
- Maximum allowable pressure relief valve setting (P3)=41 MPa or 6,000 psi
- Tensile load to open pressure relief valve (F3)=160 kN or 36,000 lbs Hydraulic Jar with a large ID and two high pressure chambers:

- Swept area of Hydraulic Valve (A4)=39 cm^2 or 6 in^2
- Maximum allowable pressure relief valve setting (P4)=41 MPa or 6,000 psi
- Tensile load to open pressure relief valve (F4)=320 kN or 72,000 lbs In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A hydraulic jar having multiple high pressure chambers, comprising:

a jar body comprising an inner body telescopically engaged by an outer body, the jar body moving telescopically between a pre-jarring position and a jarring position;

a first contact surface carried by the inner body, and a second contact surface carried by the outer body, the first contact surface axially engaging the second contact surface when the jar body is moved to the jarring position; and a plurality of pressure chambers comprising at least a first pressure chamber and a second pressure chamber axially spaced from the first pressure chamber, each pressure chamber being defined radially by the outer body and the inner body, and defined axially by a first seal element at a first end of the pressure chamber and a second seal element at a second end of the pressure chamber, the first pressure chamber comprising:

a first jarring section toward the second end of the first pressure chamber and a first hydraulic delay section between the first jarring section and the first end of the first pressure chamber;

a first piston that separates the first pressure chamber into a first fluid section towards the first end and a second fluid section towards the second end and moves relative to the first pressure chamber;

a first jarring valve that is closed when the first piston is in the first hydraulic delay section and is open when the first piston is in the first jarring section;

a first hydraulic delay that is in fluid communication with the first fluid section and the second fluid section and that controls flow of hydraulic fluid under pressure from the first fluid section to the second fluid section to permit movement of the first piston toward the second end of the first pressure chamber at a first speed;

wherein when the first jarring valve is open the first piston moves toward the second end of the first pressure chamber at a second speed that is greater than the first speed;

the second pressure chamber comprising:

a second jarring section toward the second end of the second pressure chamber and a second hydraulic delay section between the second jarring section and the first end of the second pressure chamber;

a second piston that separates the second pressure chamber into a first fluid section towards the first end and a second fluid section toward the second end and moves relative to the second pressure chamber;

a second jarring valve that is closed when the second piston is in the second hydraulic delay section and is open when the second piston is in the second jarring section;

a second hydraulic delay that is in fluid communication with the first fluid section and the second fluid section and that controls flow of hydraulic fluid under pressure from the first fluid section to the second fluid section to permit movement of the second piston toward the second end of the second pressure chamber at a first speed;

wherein when the second jarring valve is open the second piston moves toward the second end of the second pressure chamber at a second speed that is greater than the first speed;

wherein the first hydraulic delay and the second hydraulic delay are configured to simultaneously control flow of the hydraulic fluid from the first fluid section to the second fluid section of the first and second pressure chambers respectively, such that the first and second pistons move simultaneously in the same direction at the first speed or at the second speed towards the second end of the first and second pressure chambers respectively.

2. The hydraulic jar of claim 1, wherein the first and second seal elements of the pressure chambers are carried by the inner body, and the first and second pistons are carried by the outer body.

3. The hydraulic jar of claim 1, wherein the second seal element of the first pressure chamber comprises the first seal element of the second pressure chamber adjacent to the first pressure chamber.

4. The hydraulic jar of claim 1, wherein the first and second jarring valves comprise an enlarged flow area between the inner body and the outer body such that the hydraulic fluid escapes around the first and second pistons respectively from the first fluid section to the second fluid section when the first and second jarring valves are open.

5. The hydraulic jar of claim 1, wherein the first and second hydraulic delays comprise one or more flow orifices that restrict flow of the hydraulic fluid from the first fluid section to the second fluid section at a predetermined rate.

6. The hydraulic jar of claim 1, wherein each of the first and second pressure chambers further comprises a pressure relief valve that opens upon application of a predetermined hydraulic pressure to the first and second pistons in the first and second hydraulic delay sections respectively.

7. The hydraulic jar of claim 1, wherein:

the first pressure chamber further comprises: a first opposed jarring section towards the first end of the first pressure chamber; a first opposed jarring valve that is closed when the first piston is in the first hydraulic delay section and is open when the first piston is in the first opposed jarring section; a first opposed hydraulic delay that is in fluid communication with the first fluid section and the second fluid section and that controls flow of hydraulic fluid under pressure from the second fluid section to the first fluid section to permit movement of the first piston toward the first end of the first pressure chamber at a third speed, wherein when the first opposed jarring valve is open the first piston moves toward the first end of the first pressure chamber at a fourth speed that is greater than the third speed, and the second pressure chamber further comprises: a second opposed jarring section towards the first end of the second pressure chamber; a second opposed jarring valve that is closed when the second piston is in the second hydraulic delay section and is open when the second piston is in the second opposed jarring section; a second opposed hydraulic delay that is in fluid communication with the first fluid section and the second fluid section and that controls flow of hydraulic fluid from the second fluid section to the first fluid section to permit movement of the second piston toward the first end of the second pressure chamber at a third speed, wherein when the second opposed jarring valve is open the second piston moves toward the first end of the second pressure chamber at a fourth speed that is greater than the third speed, wherein the first opposed hydraulic delay and the second opposed hydraulic delay are configured to simultaneously control flow of the hydraulic fluid from the second fluid section to the first fluid section of the first and second pressure chambers respectively, such that the first and second pistons move simultaneously in the same direction at the third speed or at the fourth speed towards the first end of the first and second pressure chambers respectively.

* * * * *